US006035684A

United States Patent [19]

Jepsen et al.

[11] Patent Number: 6,035,684

[45] Date of Patent: Mar. 14, 2000

[54] METHOD OF ROLLING STRIP, PARTICULARLY METAL STRIP

[75] Inventors: Olaf Norman Jepsen, Siegen; Alfred Eugen Metzul, Dietzhölztal, both of Germany

[73] Assignee: SMS Schloemann-Siemag Aktiengessellschaft, Düssenldorf, Germany

[21] Appl. No.: 09/247,456

[22] Filed: Feb. 10, 1999

[30] Foreign Application Priority Data

Feb. 14, 1998 [DE] Germany ..... 198 06 161

[51] Int. Cl.[7] ..... B21B 13/08

[52] U.S. Cl. ..... 72/234; 72/9.2; 72/11.8; 72/365.2

[58] Field of Search ..... 72/7.6, 8.3, 8.9, 72/9.2, 11.1, 11.6, 11.8, 205, 234, 365.2

[56] References Cited

U.S. PATENT DOCUMENTS

| | | | |
|---|---|---|---|
| 4,398,254 | 8/1983 | Kondo et al. | 72/9.2 |
| 5,495,735 | 3/1996 | Nishimura | 72/8.4 |
| 5,720,196 | 2/1998 | Tamai et al. | 72/10.4 |
| 5,761,066 | 6/1998 | Lettau et al. | 72/9.2 |

FOREIGN PATENT DOCUMENTS 2944035 11/1990 Germany .

*Primary Examiner*—Ed Tolan
*Attorney, Agent, or Firm*—Friedrich Kueffner

[57] ABSTRACT

A method of rolling strip, particularly metal strip, for example, steel strip, in a rolling train with several roll stands arranged one behind the other, wherein the strip enters each of the roll stands with a desired entry thickness and each of the roll stands is provided with a desired thickness value of the strip, and wherein the strip is to leave the respective roll stand with a thickness which corresponds to this desired thickness value; when rolling a transition portion of the strip, i.e., a portion of the strip where the thickness of the strip changes, the desired thickness value of one of the roll stands is changed from an initial desired value to a final desired value; when rolling the transition portion of the strip in any roll stand arranged subsequent to the one roll stand, the desired thickness values of these roll stands are also changed from initial desired values to final desired values. The changes of the desired thickness values in any roll stands following the one selected roll stand is carried out in such a way that for each of these roll stands the quotient of the instantaneous desired thickness value of this stand and the instantaneous desired entry thickness of this stand is a constant.

6 Claims, 3 Drawing Sheets

METHOD OF ROLLING STRIP, PARTICULARLY METAL STRIP

BACKGROUND OF THE INVENTION

1. Field of the Invention

The present invention relates to a method of rolling strip, particularly metal strip, for example, steel strip. The strip is rolled in a rolling train with several roll stands arranged one behind the other. During rolling of the strip, the strip enters each of the roll stands with a desired entry thickness and each of the roll stands is provided with a desired thickness value of the strip, wherein the strip is to leave the respective roll stand with a thickness which corresponds to this desired thickness value; when rolling a transition portion of the strip, i.e., a portion of the strip where the thickness of the strip changes, the desired thickness value of one of the roll stands is changed from an initial desired value to a final desired value; when rolling the transition portion of the strip in any roll stand arranged subsequent to the one roll stand, the desired thickness values of these roll stands are also changed from initial desired values to final desired values.

2. Description of the Related Art

A rolling method of the above-desired type is disclosed, for example, in DE 29 44 035 C2.

When rolling strip, this strip should have as much as possible a uniform thickness over the length thereof. Consequently, when the strip thickness is changed in a transition area from an initial value to a final value, the transition portion of the strip is useless and must be discarded as scrap.

SUMMARY OF THE INVENTION

Therefore, it is the primary object of the present invention to provide a rolling method in which, with as little effect on the rolling process as possible, a transition portion which is as short as possible is produced during a strip thickness change.

In accordance with the present invention, the changes of the desired thickness values in any roll stands following the one selected roll stand is carried out in such a way that for each of these roll stands the quotient of the instantaneous desired thickness value of this stand and the instantaneous desired entry thickness of this stand is a constant.

Accordingly, the special aspect of the rolling method according to the present invention is the fact that a change of the relative thickness decrease takes place only in the roll stand which rolls the thickness change, while the relative decrease always remains constant in all subsequent roll stands. This minimizes the mass flux interference between the roll stands, and no adjustment or only a very small adjustment of the rates of rotation of the roll stands is required. Consequently, the length of the transition portion can be kept very short.

Of course, in order to effect a change of the desired thickness values in the subsequent stands at the correct point in time, it is necessary to carry out precise tracking of the strip. However, such systems for tracking strip are generally known in the art.

Impact-like loads acting on the roll stands can be avoided particularly when the desired thickness value of the one roll stand is changed in a ramp-shaped manner during the rolling of the transition portion of the strip. In other words, the roll stand produces a ramp-shaped transition portion of the strip.

Of course, because of the constant relative pass reduction in the subsequent roll stands, the desired thickness values of these subsequent roll stands are also changed in a ramp-shaped manner. In addition, when a thickness change is desired following the last roll stand, it is possible because of this relationship between the desired thickness values to precalculate all other changes of the desired thickness values in the preceding roll stands.

In the rolling method according to the present invention, almost the entire mass flux change takes place in the one roll stand. Only very small mass flux changes occur in the subsequent roll stands because of the small lead changes.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
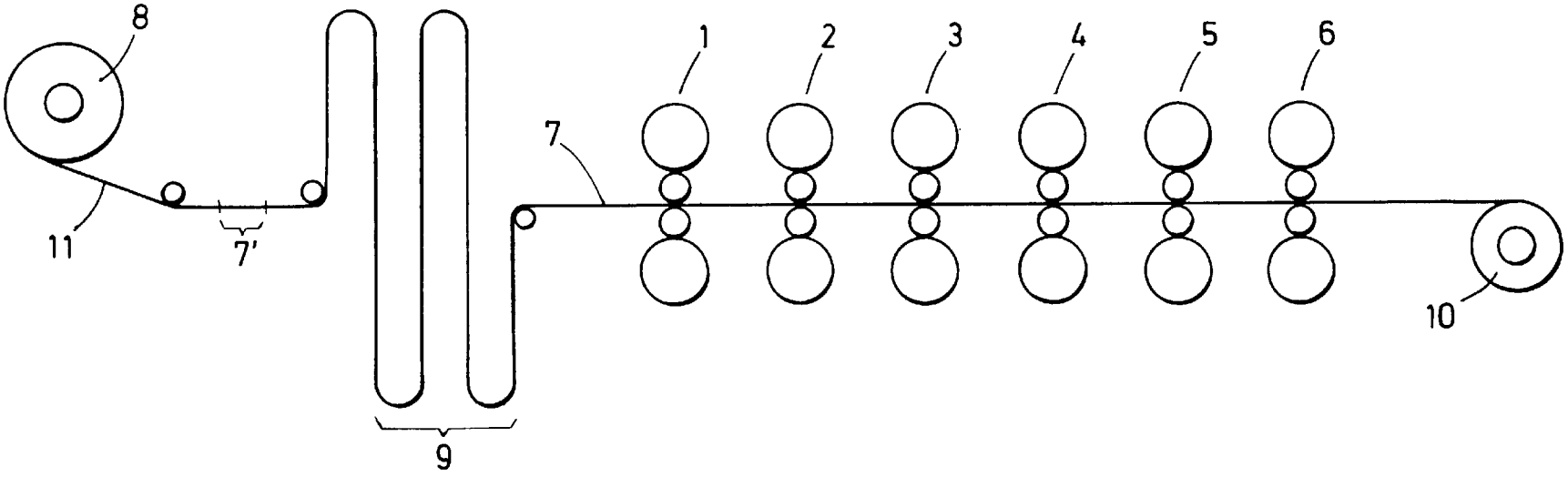
FIG. 1 is a schematic illustration of a cold rolling train with six roll stands.

As illustrated in FIG. 1 of the drawing, a cold rolling train is composed of, for example, six roll stands 1 to 6 arranged one behind the other in a rolling direction. A steel strip 7 is being rolled in the rolling train from an initial thickness $d_0$. to a final thickness $d_6$.

For rolling the strip 7, the strip 7 is initially uncoiled from an uncoiler 8, th e n travels through a strip storage unit 9 and is then threaded into the rolling train. Following the rolling train, the strip 7 is reeled on a coiler 10. During rolling of the strip 7, the strip 7 is supposed to enter in accordance with a rolling schedule into each of the roll stands 1 to 6 with a desired entry thickness $e_1^*$ to $e_6^*$. Each of the roll stands 1 to 6 is additionally provided with a desired thickness value $a_1^*$ to $a_6^*$ which is the thickness with which the strip 7 is supposed to exit from the respective roll stand 1 to 6.

The strip storage unit 9 between the uncoiler 8 and the first roll stand 1 serves to store a certain quantity of strip 7. This makes it possible to bridge short interruptions in coiling the strip from the uncoiler 8 or for welding a new strip 11 to a strip 7 which has already entered the rolling train, so that the operation of the rolling train does not have to be stopped. The new strip 11 connected to the strip 7 which is being rolled at present usually has a different strip thickness $d_0$ than the strip 7. Therefore, the strip 11 attached to the strip 7 is subjected to different rolling conditions. Consequently, in the area of the seam between the two strips 7 and 11, it is necessary to provide a transition portion 7' in which the rolling conditions can be adjusted to the new strip 11.

For this adjustment of the rolling conditions, the desired thickness value $a_1^*$ of the first roll stand 1 is changed during the rolling of the transition portion 7' of the strip 7 in a ramp-shaped manner from an initial desired value to a final desired value. In the subsequent roll stands 2 to 6, the desired thickness values $a_2^*$ to $a_6^*$ are also changed in a ramp-shaped manner from initial desired to final desired values. The changes take place in each of the roll stands 2 to 6 at a point in time in which the transition portion 7' is rolled by the respective roll stand 2 to 6. The ramp-shaped changes of the desired thickness values $a_2$* to $a_6$* are carried out in such a way that in each of the roll stands 2 to 6 the quotient of the instantaneous desired thickness value $a_2$* to $a_6$* of this roll stand 2 to 6 and the temporary desired inlet thickness $e_2$* to $e_6$* of this roll stand 2 to 6 is a constant.

Figure 2:
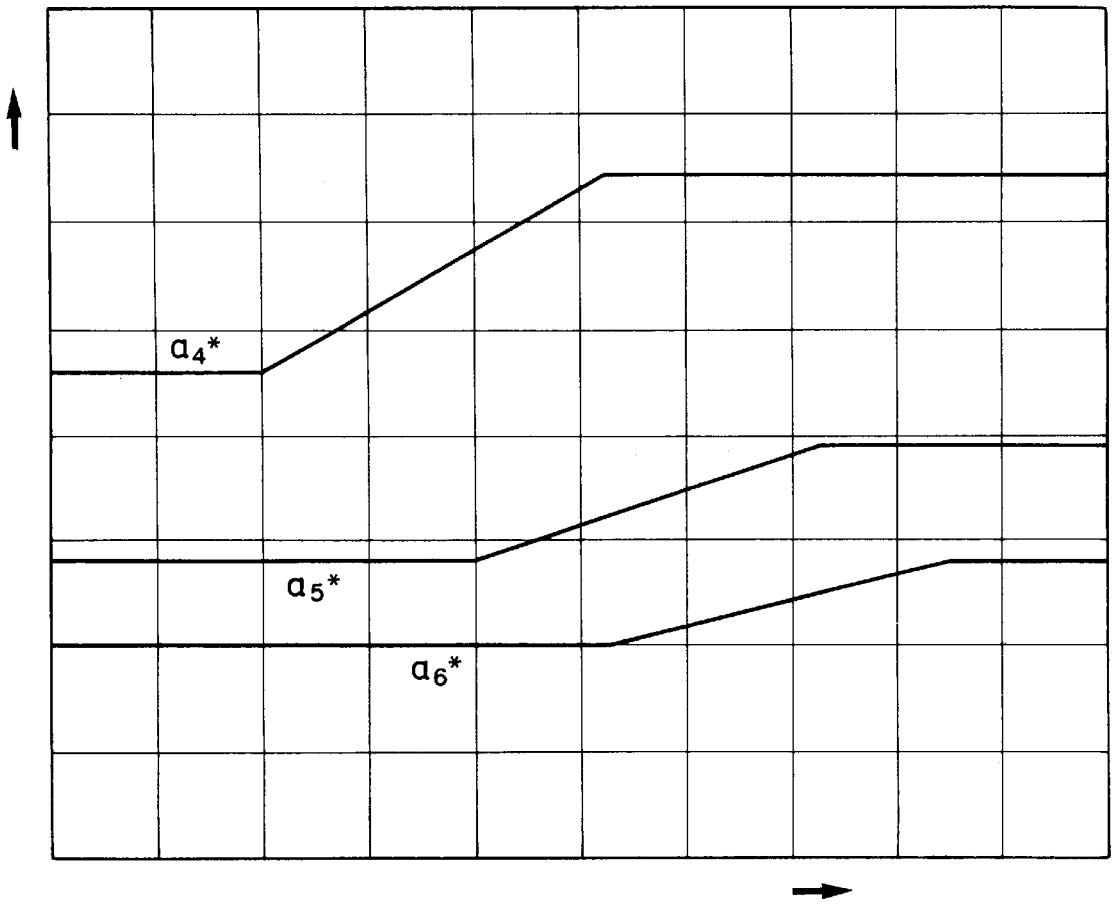
FIG. 2 is a diagram showing a desired thickness value pattern for the last three roll stands.

Alternatively, it may also be necessary to carry out a thickness change within this strip 7 during the rolling of the strip 7. In that case, the change of the desired thickness value can remain limited to some of the roll stands 1 to 6, for example, to the three last roll stands 4 to 6. In this situation, the desired thickness values $a_1$* to $a_3$* of the roll stands 1 to 3 are maintained constant, while the desired thickness values $a_4$* to $a_6$* of the roll stands 4 to 6 are changed in a ramp-shaped manner. A change of the relative pass reduction takes place only in the fourth roll stand 4. The relative pass reductions of the roll stands 5 and 6 remain constant. This situation is illustrated in FIG. 2.

If the control dynamics of the roll stands 1 to 6 make it possible, even the desired thickness values $a_1$* to $a_4$* or $a_5$* of the roll stands 1 to 4 or 5 can be kept constant. In that case, it is only necessary to change the desired thickness values $a_5$* and $a_6$* of the last two roll stands 5 and 6, or it is only necessary to change the desired thickness value $a_6$* of the last roll stand 6 from an initial desired value to a final desired value.

Figure 3:
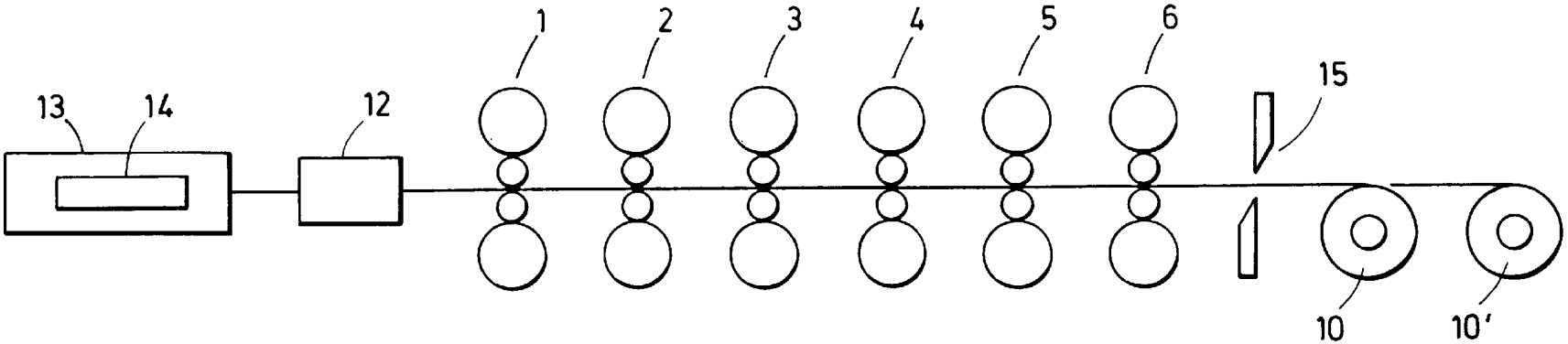
FIG. 3 is a schematic illustration of a hot rolling train with six roll stands.

In principle, the method according to the present invention can also be used in hot rolling mills. Such a hot rolling mill is shown in FIG. 3. As shown in FIG. 3, a descaler 12 and an equalizing furnace 13 are arranged in front of the first roll stand 1. In the equalizing furnace 13, a slab 14 is heated through prior to introducing it into the hot rolling train or the slab 14 is subjected to intermediate storage. The slab 14 is to be rolled, for example, into two or three strips having different final thicknesses $a_{6*}$. Accordingly, at the points where the strip thickness changes, at least the desired thickness value $a_6$* of the last roll stand 6, or possibly also the desired thickness values of additional roll stands 1 to 5, must be changed. This can be carried out in accordance with the method which is described above in connection with a cold rolling mill. The individual strips are then cut following the last roll stand 6 by means of a shear 15 and are coiled alternatingly onto one of the reels 10, 10'.

While specific embodiments of the invention have been shown and described in detail to illustrate the inventive principles, it will be understood that the invention may be embodied otherwise without departing from such principles.

We claim:

1. A method of rolling strip in a rolling train having a plurality of roll stands arranged one behind the other in a rolling direction, the method comprising rolling the strip by introducing the strip into each of the roll stands with a desired entry thickness and providing each of the roll stands with a desired thickness value with which the strip is to exit from the respective roll stand, changing during rolling of a transition portion of the strip the desired thickness value of a selected roll stand from an initial desired value to a final desired value, changing in any of the roll stands following the selected roll stand during rolling of the transition portion of the strip also the desired thickness values of the roll stands following the selected roll stand from initial desired values to final desired values, and carrying out the changes of the desired thickness values in the roll stands following the selected roll stand in such a way that for each of the roll stands following the selected roll stand a quotient of a temporary desired thickness value and an instantaneous desired inlet thickness is a constant.

2. The rolling method according to claim 1, comprising changing the desired thickness value of the selected roll stand during rolling of the transition portion of the strip in a ramp-shaped manner.

3. The rolling method according to claim 1, comprising arranging at least one roll stand following the selected roll stand.

4. The rolling method according to claim 3, comprising selecting the first roll stand of the rolling train as the selected roll stand.

5. The rolling method according to claim 1, comprising using the method in a hot rolling train.

6. The rolling method according to claim 1, comprising using the method in a cold rolling train.

* * * * *